United States Patent [19]

Holtz

[11] 4,223,887

[45] Sep. 23, 1980

[54] EXERCISE SUPERVISION DEVICE

[76] Inventor: Gilbert J. Holtz, 182 Tibbetts Rd., Yonkers, N.Y. 10705

[21] Appl. No.: 61,290

[22] Filed: Jul. 27, 1979

[51] Int. Cl.[3] ..... A63B 23/04

[52] U.S. Cl. ..... 272/70; 272/DIG. 5; 235/99 R

[58] Field of Search ..... 272/70, 96, 100, 135, 272/138, DIG. 5; 235/99 R, 99 A

[56] References Cited

U.S. PATENT DOCUMENTS

| | | | |
|---|---|---|---|
| 1,074,002 | 9/1913 | McGahey | 235/99 R |
| 1,238,283 | 8/1917 | Gillam | 235/99 R |
| 2,077,767 | 4/1937 | Morse, Jr. | 235/99 R |
| 3,627,313 | 12/1971 | Schonfeld | 272/70 UX |
| 3,634,895 | 1/1972 | Childer's | 272/70 UX |
| 3,638,940 | 2/1972 | Mehaulic | 272/70 UX |
| 3,641,601 | 2/1972 | Sieg | 272/70 UX |

FOREIGN PATENT DOCUMENTS

| | | | |
|---|---|---|---|
| 540638 | 12/1931 | Fed. Rep. of Germany | 235/99 |

*Primary Examiner*—Richard C. Pinkham
*Assistant Examiner*—Arnold W. Kramer
*Attorney, Agent, or Firm*—Bauer & Amer

[57] ABSTRACT

An exercise supervision device for recording the number of footsteps taken by a jogger while running in place on the device includes a linearly depressible jogging surface and a rotatively operable counter and structure directly connecting the jogging surface and counter for converting the linear motion of the jogging surface to a rotative traverse effective to operatively increment the counter.

4 Claims, 5 Drawing Figures

EXERCISE SUPERVISION DEVICE

The present invention relates to an exercise supervision device and, more particularly, to a supervision device for jogging or running in place.

With the recent recognition of the many physical and psychological health benefits of regular exercise, growing numbers of people have taken to jogging or running as an aid to maintaining themselves in good health. It is not uncommon for a jogger to run each day of the week at a particular time —as for example early in the morning—and the desire to avoid disrupting one's daily exercise or fitness program often drives the jogger to run in inclement weather in which he might not otherwise wish to venture out and which could prove more harmful to his health than the benefits obtained from a single day's running. Some people merely discontinue their jogging routine in the face of bad weather or the like—as during the winter season in cold climates—and might find it difficult to begin again upon the return of warmer or more clement weather. Although one solution would be to exercise indoors by running in place, the need to concentrate on counting one's footsteps and thereby keep track of the "distance" effectively traversed while running in one place can discourage even the most faithful jogging enthusiast. Merely timing the period spent running indoors, while easier, is not always an accurate indication of effective distance traversed since the rate of alternating leg motion often varies significantly when running in place as opposed to outdoor jogs along a selected route or path.

It is therefore the desideratum of the present invention to provide a device which supervises a person exercising by running in place. More particularly, it is an object of the invention to provide an exercise supervision device which automatically records the number of footsteps taken by a jogger while running in place and which provides an easily and continuously visible indication thereof for assisting the jogger in ascertaining the relative distance he has effectively traversed.

It is another object of the present invention to provide such a device in which the operative components are connected together and interact with each other in an advantageously simple and reliable manner.

It is a further object of the invention to provide such a device which utilizes a mechanical counter having a shaft movable through a rotative traverse for operatively incrementing the counter and which provides a direct connection between the linearly vertically movable jogging surface and the rotatively movable counter shaft while accommodating the motion lost in converting from a linear to a rotative motion for operating the counter.

Further objects, features and advantages of the present invention will be more fully appreciated by reference to the following detailed description of a presently preferred, but nonetheless illustrative, embodiment in accordance with the present invention when taken in conjunction with the accompanying drawings, wherein.

DETAILED DESCRIPTION OF THE PREFERRED EMBODIMENT

Figure 1:
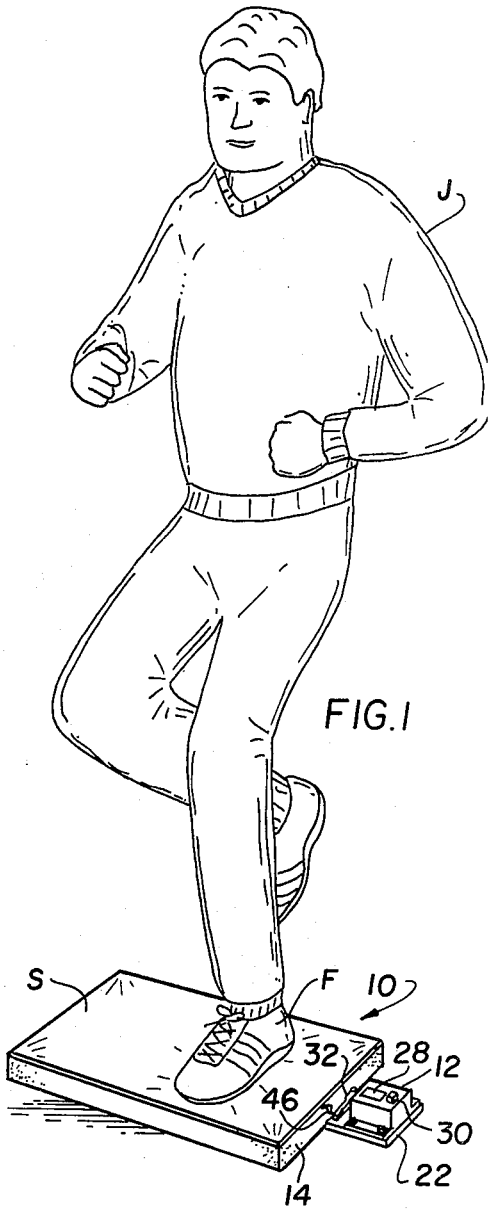
FIG. 1 is an elevated perspective view of a jogger utilizing a supervision device constructed in accordance with the present invention.

There is depicted in FIG. 1 a jogger J running in place atop an exercise supervision device generally designated 10 and constructed in accordance with the teachings of the present invention. Each alternating stepping and lifting movement of one of the jogger's legs on the device 10 causes a counter 12 thereof to be advanced or incremented to the next succeeding count and the supervision device accordingly provides a continuous indication of the number of steps taken by the runner. Since the number of steps taken is proportional to the distance which the jogger would normally cover while running, the supervision device 10 essentially provides a measure of the relative distance effectively traversed by the jogger J while running in place on the unit 10.

Figure 2:
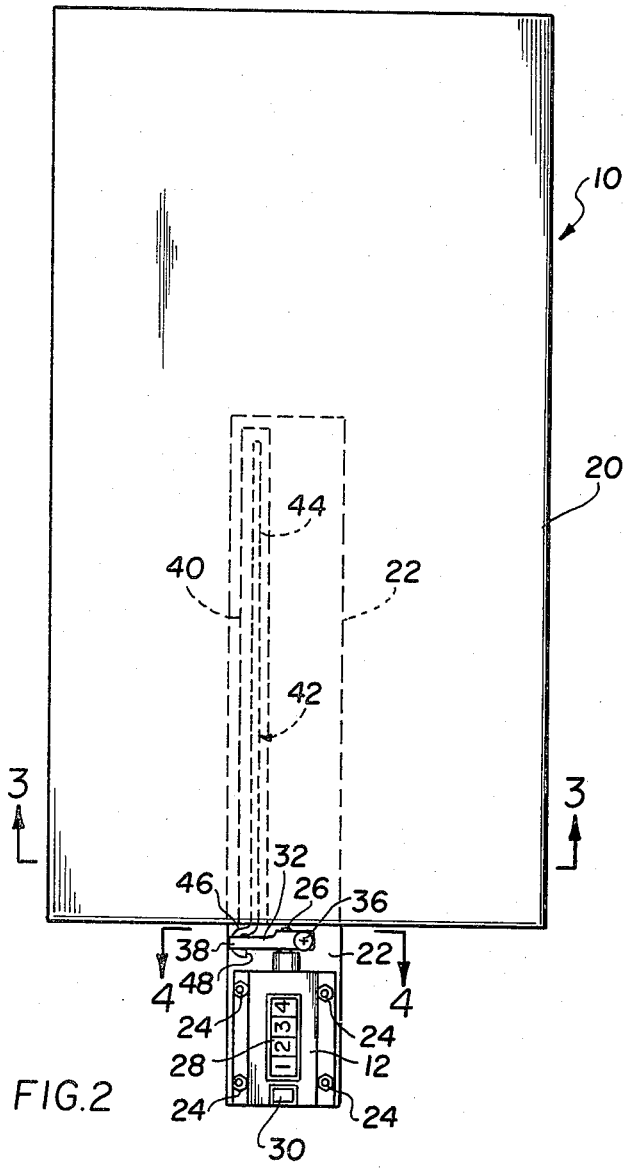
FIG. 2 is a plan view of a jogging supervision device in accordance with the invention.

The constructural details of the inventive exercise supervision device 10 is more particularly seen in FIGS. 2 through 4 and will now be described with respect thereto. An elongated pad or bed 14 formed of a resiliently deformable material such as foam rubber or the like is shown as substantially rectangularly configured although the precise shape of the pad is not critical. Compression of the pad 14 causes the same to exhibit a return urgency in a direction opposite the compression for restoring the pad to its initial, noncompressed condition.

The pad 14 supportingly carries a rigid plate-like member 16 which is contiguously coextensive with at least the full length and width of the pad and which defines a rigid simulated jogging surface on which it is intended that the jogger exercise. In order to provide some cushioning of the jogging surface and thereby more closely simulate the support consistency of a running track or of a grassy surface the plate 16 may carry a relatively thin layer of foam 18 or other cushioning material and the rigid plate 16 and cushioning foam 18 may be together encased in a protective cover 20 of vinyl or the like. The vinyl cover 20 is preferably secured, as with cement, to the underlying pad or bed 14 so as to prevent lateral movement or displacement of the jogging surface S from its contiguous and superposed position coextensively atop the resilient pad 14.

A base plate 22 is cemented or otherwise positionally fixed to the underside of the pad 14 substantially centrally along and parallel to the pad elongation and includes a portion projecting beyond the edge of the pad. The counter 12 is carried on the edge projection portion of the base plate and may be mounted or secured thereto with screws 24 or the like so that the counter is positionally fixed adjacent one end of the elongation of the resilient pad 14. A shaft 26 of the counter 12 is movable through a rotative traverse for advancing or incrementing the count thereof which is visible through a window 28. A reset button 30 on the upper surface of the counter 12 is depressible, as with the jogger's foot from an upright or standing position, for initializing the count to zero.

The counter shaft 26 carries a generally elongated connecting member 32 which is fixed to the shaft for rotative movement therewith. More particularly, the member 32 includes, at one end of its elongation, a pair of arms 34 for clamped engagement on the counter shaft 26 by way of a screw 36 adjustable for tightening the arms 34 about the shaft 26. The connecting member 32 extends radially outward from its engagement with the shaft 26 so that movement of the shaft through an operatively count-incrementing rotative traverse carries the radially outwardly disposed end 38 of the connecting member 32 through or along an arc centered at the counter shaft. Conversely, and of more immediate pertinence to the operation of the device 10, movement of the connecting member's outward end 38 along such an arc is effective to drive the counter shaft 26 through a count-incrementing rotative traverse. An aperture, the purpose of which will soon become clear, is defined in and through the radially outward end 38 of the connecting member 32.

Positioned between the resilient pad 14 and the envelope or cover 20 of the superposed jogging surface S is a tubular sleeve 40. The sleeve is relatively narrow and elongated and extends substantially centrally along and parallel to the elongation of the pad 14 from its counter-disposed end to the interior thereof. Thus, the sleeve 40 essentially overlays the longitudinal extension of the base plate 22 except that each lies along an opposite face of the pad or bed 14 which separates the two and the tubular sleeve 40 does not extend beyond the pad edge as does the counter-supporting base plate 22. The end of the sleeve 40 disposed adjacent the counter 12 is open so as to provide access to the sleeve interior and the sleeve is cemented or otherwise positionally secured against relative movement to the pad 14 and/or the cover 20 between which the sleeve is located.

A rigid operating bar or link generally designated 42 includes a straight, rod-like portion 44 disposed within and along substantially the full length of the tubular sleeve 40 and a curved or hooked end portion 46 unitarily connected to the portion 44 and extending outward from the open end of the sleeve 40. The hooked end portion 46 is relatively movably received in or journalled through the aperture defined in the radially outer end 38 of the connecting member 32 so that the link 42 is axially rotatable with respect to the member 32. That is, the hooked end portion 46 of the link 42 is sufficiently loosely journalled through the connecting member aperture so as to permit rotative movement of the end portion 46 so journalled with respect to the connecting member 32. At the same time, the operating link hooked end 46 is configured so that the terminating position of the tip 48 inhibits an inadvertent disengagement or release of the hooked end 46 from its journalled connection with the member 32. As then perhaps best seen in FIG. 2, the connection of the operating link 42 with the counter shaft 26 through the connecting member 32 is radially offset with respect to the counter shaft axis. Those skilled in the art will recognize as the description proceeds that this offset connection provides a moment arm effective to facilitate the operative advancement of the counter 12 during use of the exercise supervision device 10 in the manner illustrated in FIG. 1. In addition, the extension of the operating link straight portion 44 within the sleeve 40 is seen in FIG. 2 to be laterally offset, by an amount less than the previously mentioned effect, from the longitudinal extension or axis of the counter shaft 26.

The device 10 is prepared for use by placing the same on a relatively rigid ground surface or flooring. The jogger J stations himself atop the jogging surface S defined by the rigid plate 16 and enveloped by the cover 20 so that the direction he faces is substantially perpendicular to the direction of elongation of the pad 14 and superposed jogging surface S. Thus, when the jogger begins to run in place by alternatingly lifting and then stepping down with each of his legs one leg contacts the jogging surface S on its portion or half adjacent the location of the counter 12 while the other leg alternately contacts the oppositely-disposed surfaced portion remote from the counter. Put another way, one leg is vertically reciprocated over the tubular sleeve 40 and the counteroperating link 42 disposed therein while the other leg is alternately reciprocated at a surface location beyond or remote from the longitudinal termination of the sleeve 40. As a consequence, the counter will be understood to be advanced or incremented one count for each step taken by the jogger's foot F which contacts the surface S directly over the tubular sleeve 40 and operating link 42. Reference in the following description to the jogger's foot F and its effect on the operative elements of the exercise supervision device 10 should therefore be understood to denote that foot which is positioned over the tubular sleeve 40.

In the absence of the jogger J atop or otherwise contacting the jogging surface S, the resilient pad or bed 14 is in its initial, uncompressed or expanded condition. However, it should be readily appreciated that a downwardly directed force, as for example that due to the jogger's weight, applied to a portion of the jogging surface S will cause the pad 14 to be compressed or depressed in the area of the applied force. The rigidity of the plate 16 spreads or distributes the force around the area of application so that, in effect, the plate 16 attains a downward slope in the nature of a ramp along its elongation wherein the downwardly disposed end is determined by the area of force application. In other words, when the jogger's foot F moves downwardly into contact with and against the jogging surface S, the portion of the resilient pad 14 therebelow is compressed by the rigid plate 16 which attains a downhill or descending inclination oriented toward the counter 12.

Figure 3:
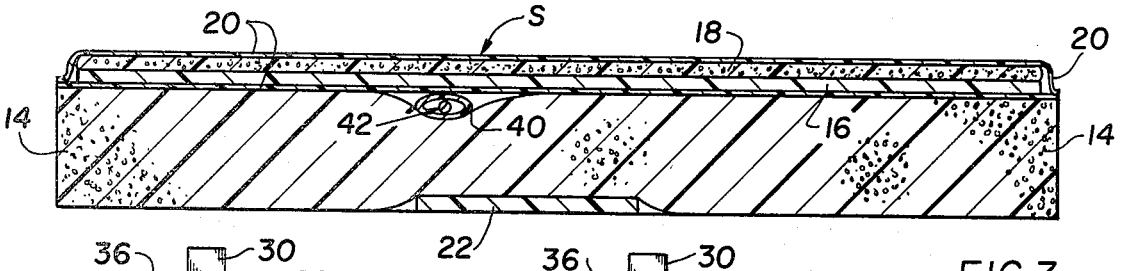
FIG. 3 is a side elevational view of the supervision device taken along the lines 3—3 in FIG. 2.
Figure 4A:
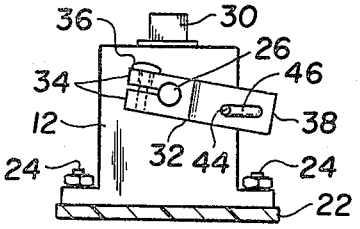
FIG. 4A and 4B are elevated side views of the counter and the operative connections thereto taken along the lines 4—4 in FIG. 2 and illustrating different positions of the operative connecting members.

The initial or starting condition of the pad 14 and the superposed jogging surface S including the operating link 42 and sleeve 40 positioned therebetween is seen in FIG. 3. Similarly, FIG. 4A shows the position of the operating link 42 and connecting member 32 with respect to the counter 12 prior to compression of the jogging surface S and the supporting pad 14. It will be noted that initially the connecting member 32 extends substantially horizontally outward from its engagement with the counter shaft 26, and that the hooked end portion 38 of the operating link 42, the curvature of which end portion is substantially planar in the illustrated embodiment, is also disposed in a generally horizontal orientation.

Downward pressure applied to the jogging surface S as the jogger's foot F is moved against the same causes a corresponding substantially vertically descending movement of the rigid plate 16 against the oppositely or upwardly exerted return urgency of the underlying resilient pad 14. As the plate 16 is depressed it carries before it the tubular sleeve 40 fixed or otherwise positioned adjacent its lower face. The sleeve 40, in turn, carries the operating link 42, the straight portion 44 of which is disposed within and along the sleeve, through the linearly descending movement of the rigid plate 16.

The linearly descending movement of the operating link 42 is transferred, at its hooked end portion 46, to the radially outer end 38 of the connecting member 32 for driving the same through a counter-operating movement or traverse. However, it will be recalled that the positionally-fixed and clamped engagement of the opposite end of the member 32 on the counter shaft 26 requires that the radially outward end 38 of the member 32 traverse an arc rather than the linear path of the operating link 42 and, in particular, of its sleeve-disposed straight portion 44. It is consequently necessary to dissipate or "lose" a certain amount of the linear movement or motion imparted by the linearly descending link 42 in order to drive the connecting member outer end 38 through its counter-operating arcuate traverse. This "lost motion" is taken up by the operating link 42 as will now be described.

Figure 4B:
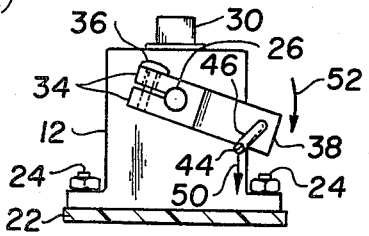

Referring now to FIG. 4B, the sleeve-disposed straight portion 44 of the link 42 is carried before the descending rigid plate 16 linearly downwardly as indicated by the arrow 50. The journalled engagement of the operating link hooked end 46 with the connecting member outer end 38 exerts a downwardly-directed force on the outer end 38 and causes the same to begin a descending pivotal or arcuate traverse, indicated by the arrow 52, centered about and effecting rotation of the counter shaft 26. This arcuate traverse carries the journalled connection of the link hooked end 46 with the connecting member 32 leftward as well as downward, in FIG. 4B and consequently toward the sleeve-confined extension of the operating link straight portion 44.

Because the lateral distance or spacing between the journalled engagement of the operating link hooked end 46 and connecting member 32 and the extension of the link straight portion 44 is, as a result of the arcuate traverse of the connecting member outer end 38, decreasing, and since the lateral position of the straight portion 44 of the rigid operating link 42 is fixed or maintained by its confinement within the narrow tubular sleeve 40, the initial substantially horizontal orientation of the link hooked portion 46 must change so as to give way to the decreasing spacing. Accordingly, the link straight portion 44 is caused to rotate within and relative to the confining sleeve 40 and the curved portion 46 of the unitary operating link 42 correspondingly rotates about its journalled engagement with the connecting member 32 to an increasingly vertical orientation so as to accommodate the aforementioned decreasing distance or spacing.

Thus, the provision of the hooked end 46 on the unitary and rigid operating link 42, and its ability to adjustably rotate with respect to the connecting member 32, provides the operating link with the ability to take up the lost motion inherent in the conversion of the linear motion 50 to an arcuate traverse 52. In addition, the confinement of the operating link straight portion 44 within a narrow tubular sleeve 40 so as to prevent lateral movement of the operating link enables the lost motion to be accommodated by rotation of the link hooked end 46 rather than by undesired lateral displacement of the operating link straight portion 44 between the pad 44 and superposed rigid plate 16. In this manner a direct connection, by way of the operating link 42 and connecting member 32, is provided in the conversion of a linear motion to a rotatively-driven traverse.

When the jogger J subsequently lifts his foot F from atop the jogging surface S, the aforementioned return urgency of the resilient pad or bed 14 is sufficient to return the rigid plate 16 and each of the operating elements and components of the device 10 to its initial or starting position as shown in FIGS. 3 and 4A. Depending upon the construction of the counter 12, the count thereof may be incremented either during the initial depression of the jogging surface S or on its subsequent upward return under the urgency of the resilient pad 14. The counter 12 will accordingly register the number of depressions of the jogging surface S by the jogger's foot F and thereby provide an indication of the relative distance effectively traversed by the jogger J while actually running in place atop the exercise supervision device 10.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In an exercise supervision device for recording the number of footsteps taken by a jogger while running in place so as to indicate the relative distance effectively traversed by the jogger and including an elongated pad fabricated of resiliently deformable material so that compression of the pad causes the same to exhibit a return urgency in a direction opposite the compression for returning the pad to its initial, non-compressed condition, a rigid plate disposed supportedly atop the pad and defining a simulated jogging surface movable through a linear, substantially vertical reciprocating traverse by alternating compression and return expansion of the underlying pad as the jogger runs in place on the plate, and a counter located adjacent one end of the elongation of the pad and operable for recording and indicating the number of footsteps taken by the jogger and including a counter shaft movable through a rotative traverse for operating the counter such that each rotative traverse of the shaft causes the counter to increment to the next count, means connecting the jogging surface to the counter for converting the linear motion of the rigid plate to the rotative traverse required to operate the counter, said means comprising:

an elongated sleeve positionally fixed between the plate and the underlying pad and extending from the counter end of the pad toward the interior thereof and substantially along the direction of pad elongation for linear reciprocating movement of said sleeve with corresponding movement of the plate, said sleeve including an opening defined at its end adjacent the counter, a rigid operating link having a straight portion disposed in said sleeve and a curved portion unitarily connected to said straight portion and extending beyond said sleeve opening and the counter end of the pad, and a connecting member fixed to the counter shaft for rotation with the shaft and extending radially outward therefrom for relatively movable connection with said operating link curved portion at said radially outward extension of the connecting member so that the connection of said operating link with the counter shaft through said connecting member is radially offset with respect to the shaft axis, said offset connection of said operating link at its curved portion enabling the accommodation of a lost motion as the substantially vertical linear movement of the rigid plate is converted to a rotative traverse for operating a counter such that when linear substantially vertical movement of the plate occurs, the plate carries said sleeve and said operating link straight portion in the sleeve through corresponding linear movement of said link curved portion moves said connecting member radially outward extension through a pivotal traverse along an arc with respect to and centered about the counter shaft so as to effect a rotative traverse of the shaft and operatively increment the counter, the motion lost as the linearly moving link curved portion moves the connecting member radially outward extension along an arc being taken up by a rotation of said link curved portion at its connection to the connecting member and a corresponding rotation of said link straight portion in and relative to said sleeve whereby said sleeve is effective to maintain the position of said operating link with respect to the pad and overlying plate and prevent lateral displacement of said link between the pad and plate as the linear motion of the plate is converted to the operative rotative traverse of the counter shaft.

2. In an exercise supervision device according to claim 1, said elongated sleeve being predeterminately positioned between the plate and the underlying pad so that the extension of said operating link straight portion in said sleeve is laterally offset with respect to the counter shaft axis.

3. In an exercise supervision device according to claim 2, said lateral offset of the operating link straight portion being less than said offset of the operating link connection with the connecting member relative to the counter shaft axis.

4. In an exercise supervision device according to claim 1, said connecting member including an aperture defined in its radially outward extension, and said operating link curved portion being journalled through said aperture for completing said relatively movable connection of said operating link curved portion with said connecting member at its radially outward extension.

* * * * *

UNITED STATES PATENT AND TRADEMARK OFFICE

CERTIFICATE OF CORRECTION

PATENT NO. : 4,223,887

DATED : September 23, 1980

INVENTOR(S) : Gilbert J. Holtz

It is certified that error appears in the above-identified patent and that said Letters Patent are hereby corrected as shown below:

In Claim 1 -

Column 7, line 5, please correct as follows:

...corresponding linear movement of said ... should read

...corresponding linear movement and said...

Signed and Sealed this

*Twenty-fifth* Day of *November 1980*

[SEAL]

*Attest:*

SIDNEY A. DIAMOND

*Attesting Officer*

*Commissioner of Patents and Trademarks*